United States Patent [19]

Fujiwara

[11] Patent Number: 4,504,360

[45] Date of Patent: Mar. 12, 1985

[54] A HEADBOX IN A PAPER-MAKING MACHINE HAVING A FLOW RECTIFIER

[75] Inventor: Haruyoshi Fujiwara, Mihara, Japan

[73] Assignee: Mitsubishi Jukogyo Kabushiki Kaisha, Tokyo, Japan

[21] Appl. No.: 608,274

[22] Filed: May 7, 1984

Related U.S. Application Data

[63] Continuation of Ser. No. 401,980, Jul. 26, 1982, abandoned.

[30] Foreign Application Priority Data

Jul. 31, 1981 [JP] Japan ..... 56-120343
Jul. 31, 1981 [JP] Japan ..... 56-120344

[51] Int. Cl.[3] ..... D21F 1/02; D21F 1/06
[52] U.S. Cl. ..... 162/343; 162/344
[58] Field of Search ..... 162/343, 344, 347, 345, 162/346, 336

[56] References Cited

U.S. PATENT DOCUMENTS 3,486,972 12/1969 Nagell ..... 162/343
3,514,372 5/1970 Boyce et al. ..... 162/343
4,070,238 1/1978 Wahren ..... 162/343

FOREIGN PATENT DOCUMENTS 809927 4/1969 Canada ..... 162/343
2852564 6/1979 Fed. Rep. of Germany ..... 162/343

*Primary Examiner*—Steve Alvo
*Attorney, Agent, or Firm*—Wenderoth, Lind & Ponack

[57] ABSTRACT

A headbox for a paper-making machine having a flow rectifier which comprises a first flow control member disposed in a flow path and a second flow control member disposed in a downstream side of the first flow control member. Being in contact with the first flow control member, the second flow control member is so constituted that the flow stagnation phenomena generated by the first flow control member is eliminated by the second flow control member. In other words, a uniform flow rate distribution or speed is achieved across the outlet of the second flow control member by rapidly decelerating the flow therein.

1 Claim, 56 Drawing Figures

FIG. 1(B)
(PRIOR ART)
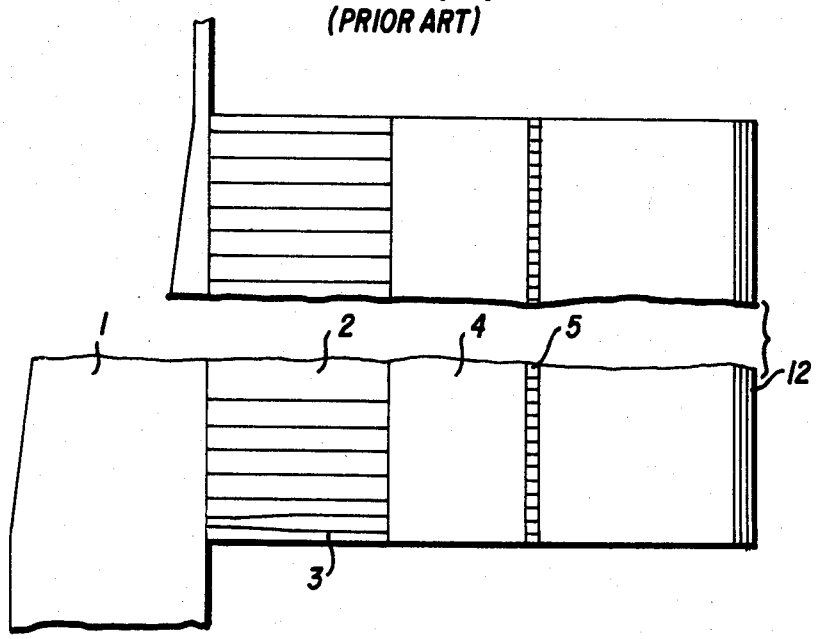
FIG. 1(A)
(PRIOR ART)
FIG. 2
(PRIOR ART)
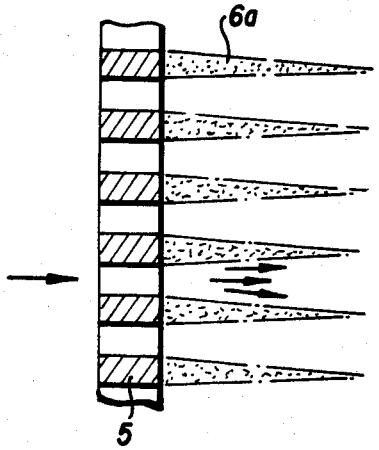
FIG. 3
(PRIOR ART)
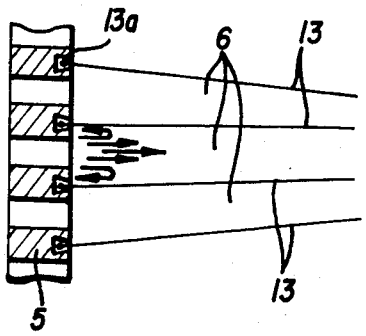

FIG. 4
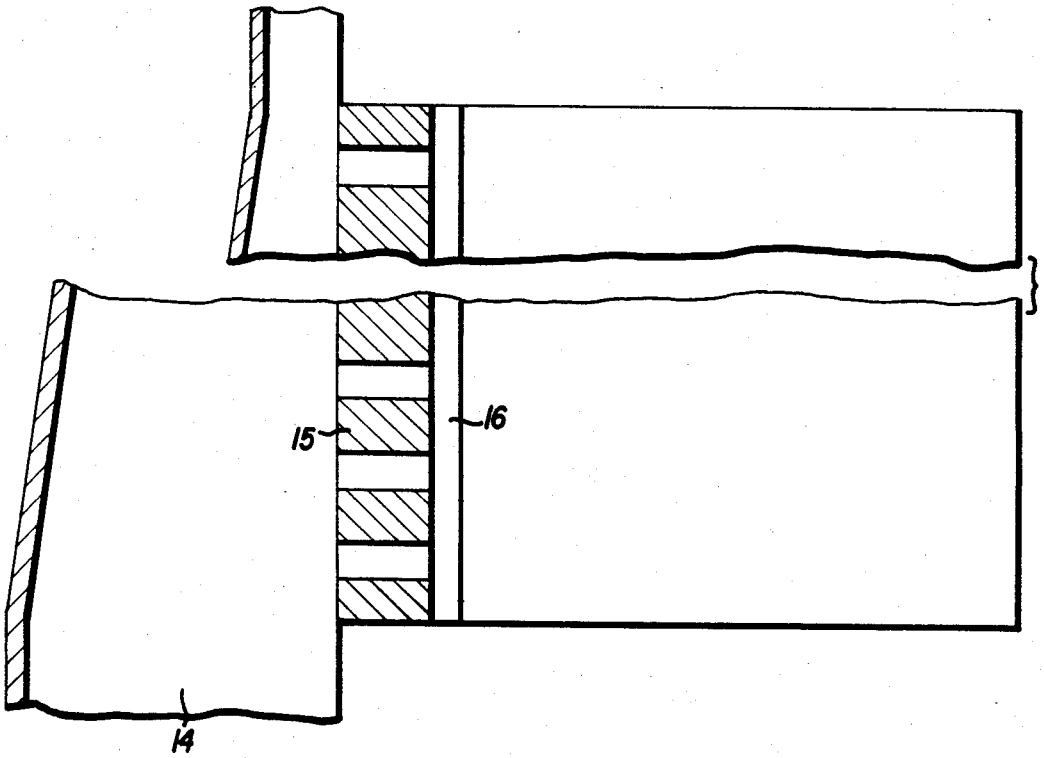
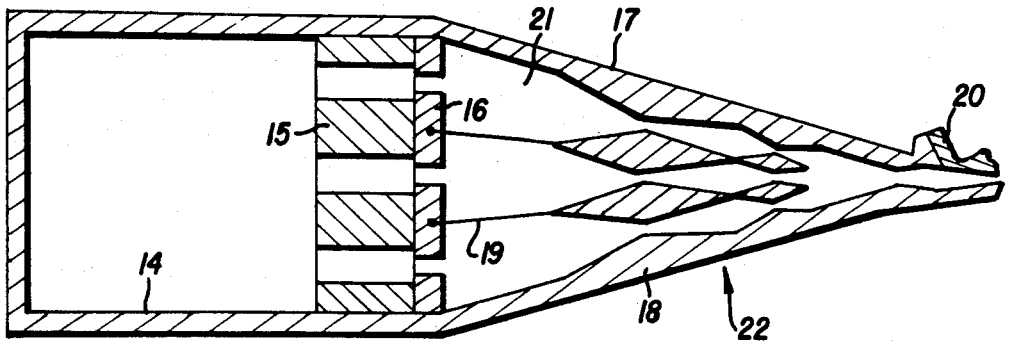
FIG. 5

FIG. 8(A)
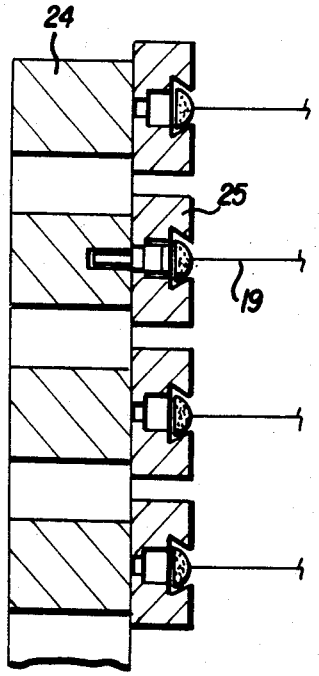
FIG. 8(B)
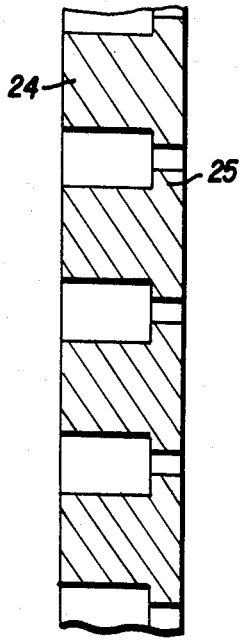
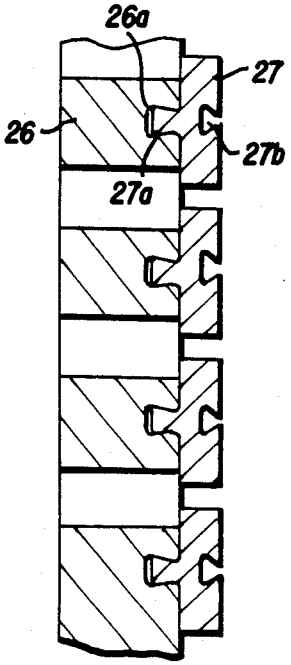
FIG. 9(A)
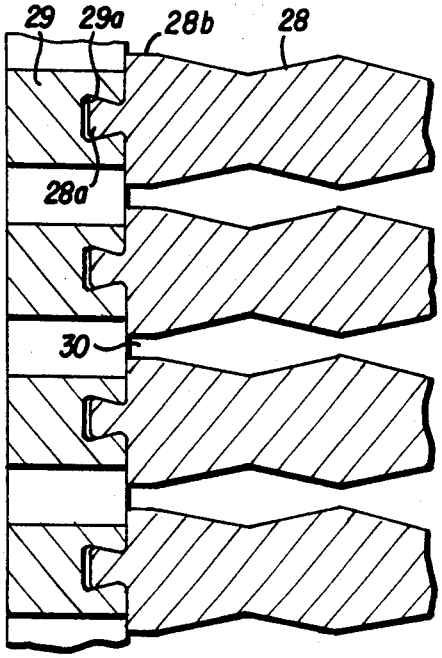
FIG. 9(B)

FIG. 16(A)
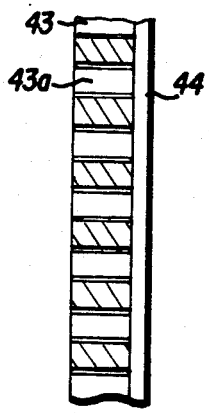
FIG. 16(B)
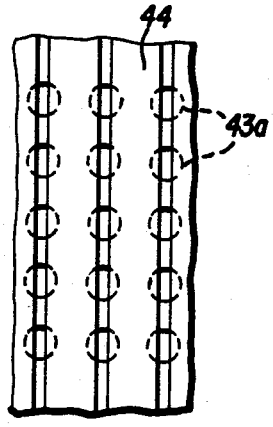
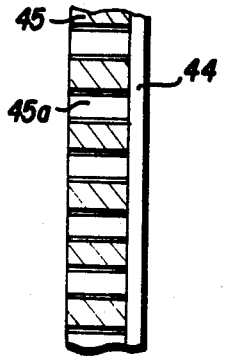
FIG. 17(A)
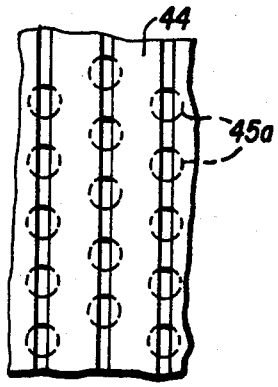
FIG. 17(B)

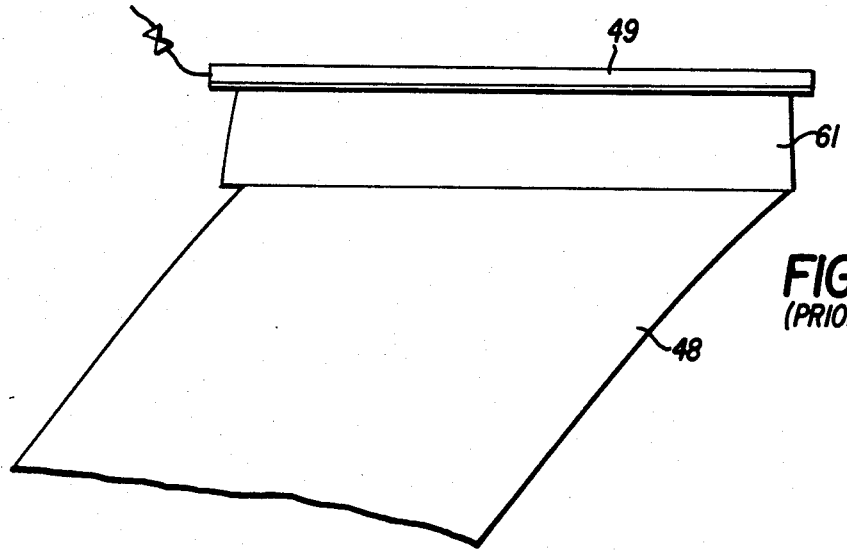
FIG. 21
(PRIOR ART)
FIG. 22(A)
(PRIOR ART)
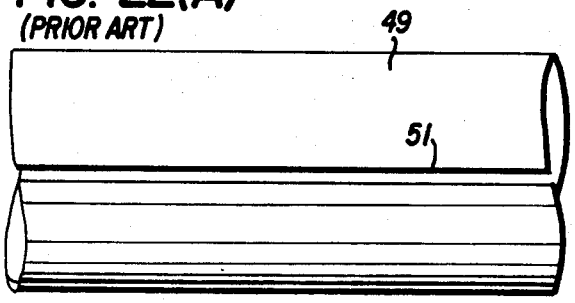
FIG. 22(B)
(PRIOR ART)
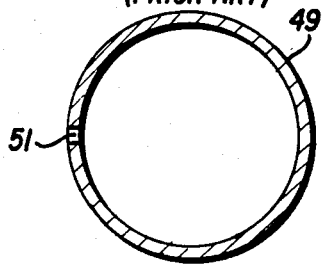
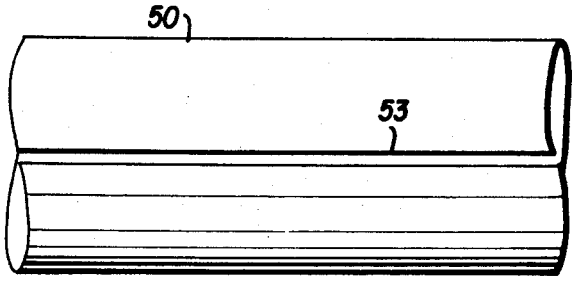
FIG. 23(A)
(PRIOR ART)
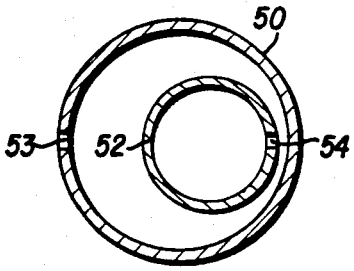
FIG. 23(B)
(PRIOR ART)

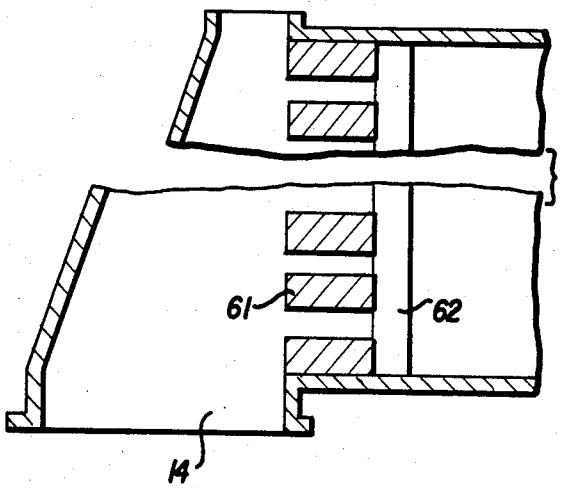
FIG. 26(B)
FIG. 26(A)
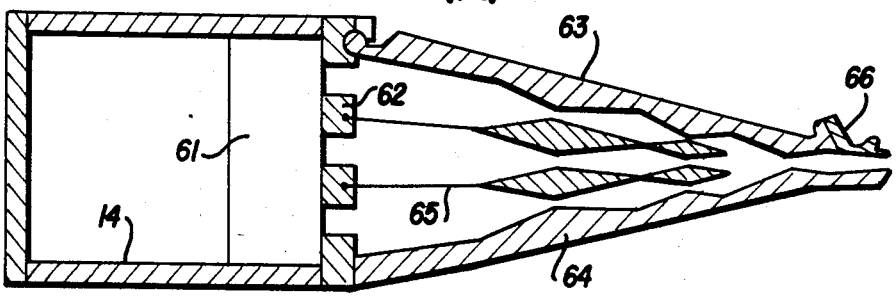
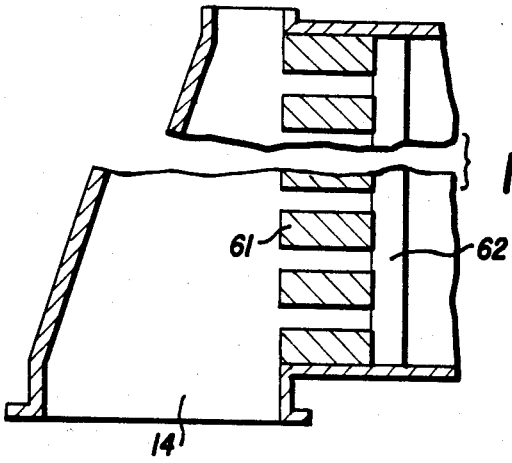
FIG. 27(B)
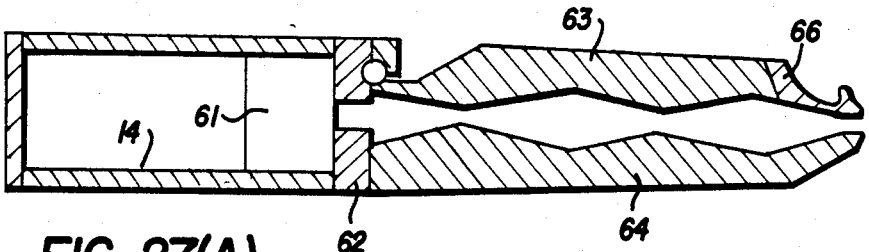
FIG. 27(A)

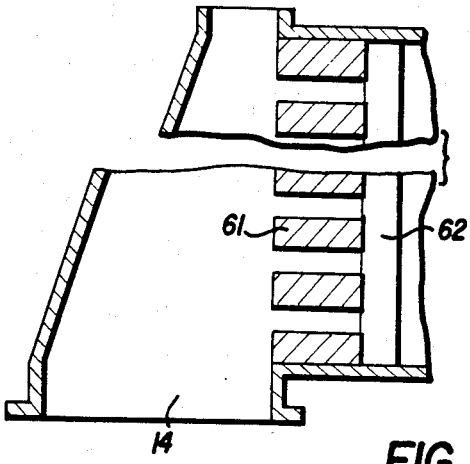
FIG. 28(B)
FIG. 28(A)
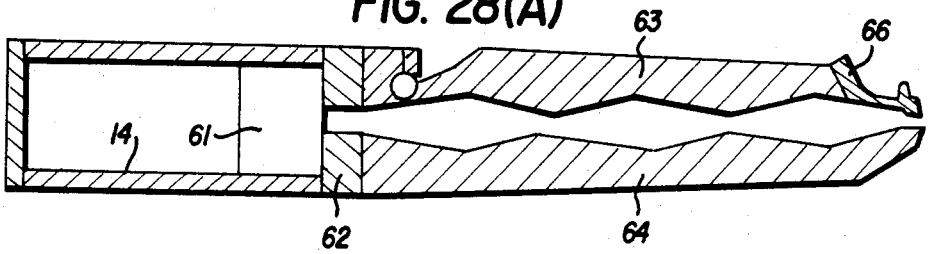
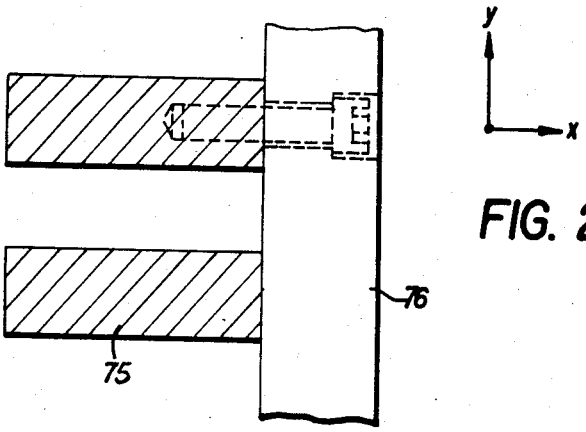
FIG. 29
FIG. 30
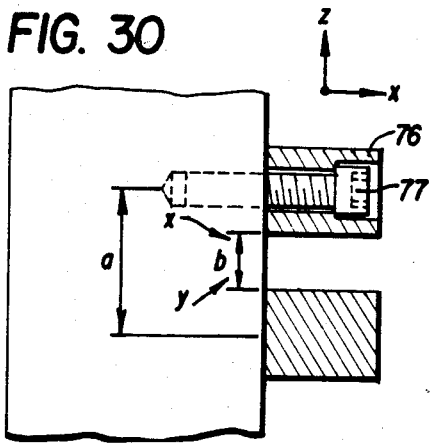
FIG. 31
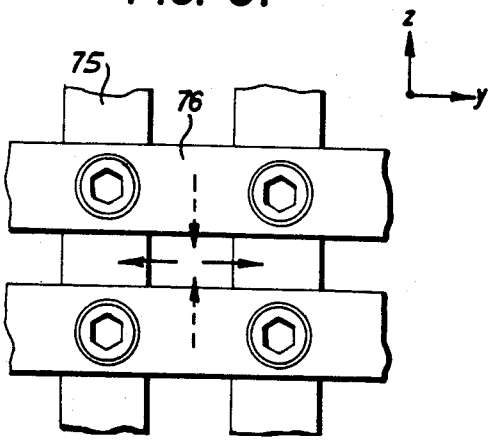

A HEADBOX IN A PAPER-MAKING MACHINE HAVING A FLOW RECTIFIER

This application is a continuation of now abandoned application Ser. No. 401,980 filed July 26, 1982.

BACKGROUND OF THE INVENTION

1. Field of the Invention

The present invention relates to a flow rectifier applicable to such equipment as a head box in a paper machine where gas or liquid is fed through widthwise arrayed perforations. More particularly, slits are prepared at the outlet of the perforations, and, from these slits, gas or liquid is fed as a jet (shower) in the form of widthwise extended film.

2. Description of the Prior Art

An example of the head box in the conventional paper machine is shown in FIGS. 1(A) and (B). Referring to these drawings, the flow of the raw paper liquid and the function thereof are described herebelow. Reference numeral 1 designates a rectangular header constituting the flow path, of which the cross-sectional area is decreased while proceeding downstream to uniformly feed the raw paper liquid to a tube bank 2. Furthermore, to make uniform the flow in the widthwise direction, it is so adapted that a part of the raw paper liquid having entered into the rectangular header 1 passes by and re-circulates in the rectangular header 1. Reference numeral 2 designates a tube bank consisting of a group of tapered tubes 3, of which the tube at the inlet side 3*a* has a small diameter to increase the pressure loss and to obtain uniform distribution in the widthwise direction, while the tube at the outlet side 3*b* has a large diameter whereby the raw paper liquid enters into a killing port 4 at low speed to facilitate mixing in the flow. In addition, the latter part is given satisfactory length to change the direction of flow by 90°.

Reference numeral 4 designates a killing part characterized by a chamber without a partition throughout the width, aimed at making uniform the pressure and the flow. Reference numeral 5 designates a perforated plate, which functions to cause the pressure loss so that the raw paper liquid is uniformly distributed in the widthwise direction. This perforated plate 5 further functions to uniformly distribute the raw paper liquid in each converging channel 6. Reference numeral 7 is a sluice chamber, and its top plate 9 and a bottom plate 10 converge toward a sluice opening 8. The top plate 9 can rotate with the fulcrum 11 as a center, thereby the clearance at the sluice opening 8 is able to be changed. On the other hand, fine adjustment of the clearance at the sluice opening 8 in the widthwise direction is effected by mechanically flexing a sluice lip 12 by means of the jacking rods (not shown) arrayed in the widthwise direction.

Moreover, as shown in FIG. 3, in the flow following the perforated plate 5, there are a number of irregularities caused in flow speed and by the influence of the jet flow ejected from the perforations. In order to damp down these turbulences in the flow, the inner space of the sluice chamber 7 is partitioned by a plurality of sheet-like restraining elements 13, forming a plurality of converging channels 6. One end 13*a* of each restraining element 13 is supported on the perforated plate 5, and the restraining elements 13 are held at the same intervals by the flow of the raw paper liquid.

However, the above-mentioned equipment in the prior art had the following shortcomings. That is, it was observed by viewing the flow that there existed a slight local difference in the flow speed in the widthwise direction at the outlet 6*b* of the converging channel 6. Such local difference in the flow speed causes turbulence in the jet after the sluice lip 12, leading to unevenness of the thickness of the jet. Presumably, such difference in the flow speed is caused by undiminished inherent characteristics of the jet flow imparted by the influence of the perforated plate 5.

In addition, when the highly concentrated raw paper liquid is allowed to flow at low flow speed in the converging channel 6 after the perforated plate 5, as shown in FIG. 2, a plurality of triangular parts 6*a* with low concentration can be observed in the widthwise direction between the adjacent jets ejected from the perforations in the perforated plate 5. Such triangular parts 6*a* with low concentration are considered to be caused because the water readily turns into the space between the adjacent jets, while the fiber is liable to flow together with the flow of the jet core, being difficult to turn into the space between the adjacent jets. These streaks with low concentration are observed to be stretched and washed away downstream.

In the meanwhile, in order for the inherent characteristics of the circular jet ejected from the perforation into the water to vanish, the length of the jet flow is generally required to be 12 to 36 times as long as the diameter of the jet flow. When the restraining elements 13 are disposed in the sluice chamber 7, inherent characteristics of the jet flow rapidly vanish; nevertheless, it has been proved that the conventional length of the sluice chamber 7 has not been sufficient to completely make uniform the flow characteristics in the widthwise direction. On the other hand, if the sluice chamber 7 is lengthened, its characteristic frequency is decreased, inner volume of the sluice chamber 7 is changed by the vibration of the top plate 9 and the bottom plate 10, and irregularity is caused in the ejection speed of the jet.

In the head box previously proposed by the inventor, the sluice chamber 7 was lengthened, and characteristic frequency of the sluice chamber 7 was successfully increased up to the practically allowable level, but it is not desirable to further lengthen the sluice chamber 7 to eliminate the influence of ejection speeds. Meanwhile, decreasing the hole diameter of the perforated plate 5 enables the length of the sluice chamber 7 to be shortened, but possible clogging of the raw paper liquid prevents the hole diameter from being decreased to less than the current size.

Originally, uniformity of the raw paper liquid in the widthwise direction is attained by the throttling effect of the tube band 2 and the perforated plate 5. Therefore, if the opening rate of the perforated plate 5 is decreased to heighten the throttling effect, the tube bank 2 may be dispensed with, but, on the other hand, if the opening rate of the perforated plate 5 is decreased to less than the status-quo, the jet speed is increased, and the distance necessary to eliminate the inherent characteristics of the jet is lengthened. Therefore, it was found difficult to make the equipment compact by dispensing with the tube bank 2.

In the meanwhile, FIG. 21 through FIG. 23 illustrate conventional shower equipment where a shower 61 of fluid is ejected from drilled holes 47 in a pipe 46 against a travelling belt 48. FIG. 21 is a perspective side view showing the shower equipment provided in the pipe 46, and FIG. 22 and FIG. 23 are respectively a front view and a cross-section side view of the pipe 46 provided with the drilled holes 47. However, this conventional shower equipment shown in FIG. 21 through FIG. 23 had the shortcoming that the shower 61 was concentrated on the parts directly below the drilled holes 47.

FIG. 24 through FIG. 26 illustrate conventional shower equipment with a slit nozzle. In the equipment shown in FIG. 24 and FIG. 25, a slit 51 is provided in a pipe 49, and the shower 61 is ejected from the slit 51 against the travelling belt 48. In this case, however, machining of the slit 51 is difficult, and, in addition, shortcomings were found. Since the part of the slit 51 was widthwise cut, it constituted the structural weak point and machining could not obtain high accuracy. Furthermore, the opening rate was larger in this case than in the case of the drilled holes 47 and irregularity in flow rate was found in the widthwise direction between the flow-in side and the flow-out side.

In the conventional shower equipment shown in FIG. 26, an inner pipe 52 is provided inside an outer pipe 50, and a slit 53 is cut in the outer pipe 50, while holes 54 are drilled in the inner pipe 52 in the opposite direction. This conventional shower equipment consists of double pipes to reduce the irregularity in the flow rate in the widthwise direction, but also has the shortcoming that the diameter of the outer pipe 50 was inevitably increased unnecessarily.

SUMMARY OF THE INVENTION

The present invention has been proposed for the purpose of eliminating the above-mentioned shortcomings in the prior art, and its principal object is to provide an improved flow rectifier which is collectively provided with the functions of the tube bank, the killing part, and the perforated plate, more specifically, the present invention can obtain uniform flow in the widthwise direction without the influence of the ejection jets from the perforations in the perforated plate by placing the slits directly following the downstream side of a plurality of drilled holes. Thus the present invention can prevent the streak with low concentration from being generated in the raw paper liquid with high concentration and at low flow speed, can reduce the cost, and can improve the vibration resistance of the sluice chamber by shortening the length thereof.

BRIEF DESCRIPTION OF THE DRAWINGS

FIG. 1(A) is a cross-section side view of an example of the conventional head box, and FIG. 1(B) is a plan view of FIG. 1(A);

FIG. 2 is an explanatory drawing showing the state of the jet in FIG. 1(A);

FIG. 3 is a detail view of the essential part in FIG. 1(A);

FIG. 4 is an enlarged cross-section plan view of drill plates and slit plates representing an embodiment of the present invention;

FIG. 5 is a cross-section side view of the head box employing drill plates and slit plates representing an embodiment of the present invention;

FIGS. 8(A) and (B), FIGS. 9(A) and (B), and FIG. 10 are respectively a cross-sectional view showing the state of combination between the drill plates and the slit plates representing an embodiment of the present invention other than the embodiment shown in FIG. 5;

FIG. 16(A) and FIG. 17(A) are cross-section side views showing the hole pattern of the drill plate representing an embodiment of the present invention, and FIG. 16(B) and FIG. 17(B) are respectively the front views of FIG. 16(A) and FIG. 17(A);

FIG. 21 is a perspective side view of conventional equipment other than the equipment shown in FIG. 18;

FIG. 22(A) and FIG. 23(A) are front views showing the slit of the pipe in FIG. 21, and FIG. 22(B) and FIG. 23(B) are respectively cross-section side views in FIG. 22(A) and FIG. 23(A);

FIG. 26(A) is a cross-section side view of the head box provided with a flow rectifier representing an embodiment of the present invention, and FIG. 26(B) is a cross-section plan view of FIG. 26(A);

FIG. 27(A) and FIG. 28(A) are cross-section side views of the head box representing an embodiment of the present invention other than the head box shown in FIG. 26(A), and FIG. 27(B) and FIG. 28(B) are respectively cross-section plan views of FIG. 27(A) and FIG. 28(A);

FIG. 29 is a plan view for explaining the slit and the slit flow rectifier representing an embodiment of the present invention, and FIG. 30 and FIG. 31 are respectively a front view and a side view of FIG. 29;

DETAILED DESCRIPTION OF THE PREFERRED EMBODIMENTS

Figure 6A:
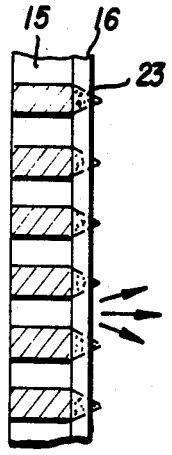
FIG. 6(A) is an explanatory drawing showing the ejection state of the jet in FIG. 4.
Figure 6B:
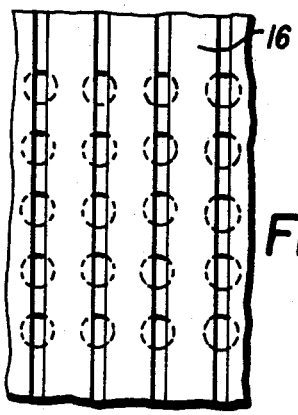
FIG. 6(B) is a front view of FIG. 6(A)
Figure 7:
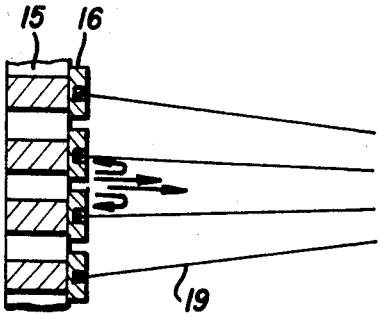
FIG. 7 is an explanatory drawing showing the state of the flow immediately after the drill plates and slit plates.

Referring now to FIG. 4 through FIG. 7, description will be made for the first embodiment of the invention. In these drawings, reference numeral 14 designates a rectangular header, and reference numeral 15 designates the first flow control member disposed in the flow path. This first flow control member 15 is a drill plate having a plurality of drilled holes. Reference numeral 16 designates the second flow control member disposed in the downstream side of, and in contact with, the first flow control member 15. This second flow control member 16 is constituted by a slit plate having a slit or slits. Reference numeral 17 is a top plate, reference numeral 18 is a bottom plate, reference numeral 19 is a restraining element, reference numeral 20 is a sluice lip, reference numeral 21 is a sluice flow path, and reference numeral 22 is a sluice chamber.

In FIG. 4 through FIG. 7, the liquid having passed through the drill plate 15 is throttled by the slit plate 16. Since, however, the slit is not restricted in the widthwise direction, the liquid flows while expanding in the widthwise direction. Reference numeral 23 in FIG. 6 designates the low concentration part of the liquid flow.

Explaining now other embodiments of the drill plate 15 and the slit plate 16 than the embodiment shown in FIG. 4 and FIG. 5, FIG. 8(A) illustrates the case where the slit plate 25 is bolted to the drill plate 24, and FIG. 8(B) illustrates the case where the drill plate 24 and the slit plate 25 are integrally constructed. FIG. 9(A) illustrates the case where the drill plate 26 has a widthwise groove 26*a*, while the slit plate 27 is provided with a widthwise extended projection 27*a* to be inserted into the groove 26*a*, and, owing to the engagement of the groove 26*a* and the projection 27*a*, the drill plate 26 and the slit plate 27 are fixedly connected with each other. Reference numeral 27*b* designates a restraining element fitting part.

Then, FIG. 9(b) illustrates the case where the widthwise extended restraining element 28 is held in the widthwise groove 29*a* of the drill plate 29 by the widthwise extended projection 28*a* provided on the restraining element 28. A fitting part 28*b* of the restraining element 28 forms the slit 30.

Figure 10:
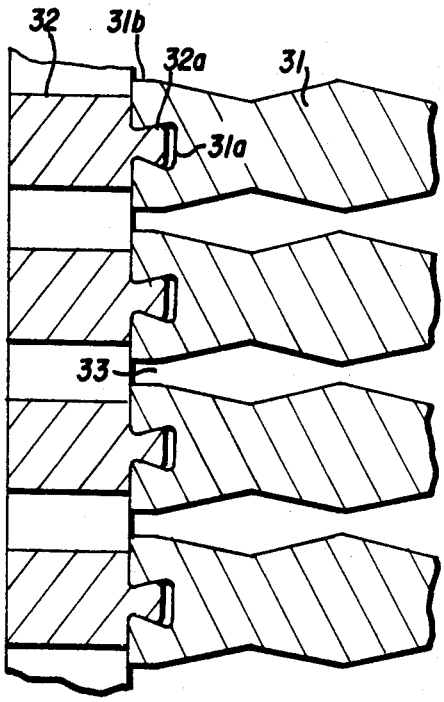

Proceeding now to FIG. 10, this is the case where the widthwise extended restraining element 31 has the widthwise groove 31*a*, and into this groove 31*a* the widthwise extended projection 32*a* of the drill plate 32 is engaged to hold both. A fitting part 31*b* of the restraining element 31 forms the slit 33. It is to be noted that, in the above-described embodiments, the drill plate 32 and the restraining element 31 can be made of plastic and other materials instead of metal.

Figure 11:
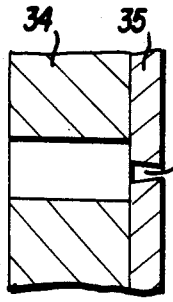
FIG. 11, FIG. 12, FIG. 13, FIG. 14, and FIG. 15 are cross-sectional views showing the shape of the slit in an embodiment of the present invention other than the embodiment shown in FIG. 5.
Figure 12:
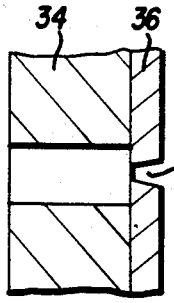
Figure 13:
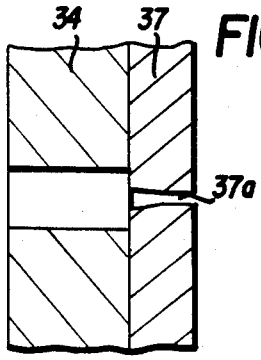

Referring now to FIG. 11 through FIG. 18, description will be made for the configuration of the slit in the slit plate. It is hereby to be noted that the configuration of the end of the slit plate is as shown in FIG. 11 through FIG. 15, but not limited thereto. In FIGS. 11 through 15, reference numeral 34 is the drill plate. In FIG. 11, reference numeral 35 is the slit plate. The slit flow path 35*a* is tapered in the downstream direction. In FIG. 12, the slit flow path 36*a* in the slit plate 36 is widening out. In FIG. 13, side walls of the slit flow path 37*a* in the slit plate 37 are first tapering and then parallel.

Figure 15:
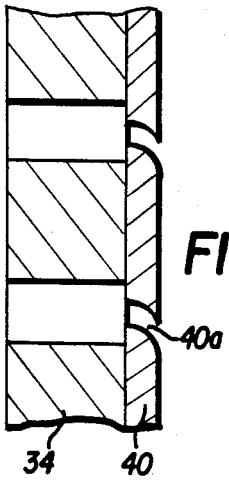
Figure 14:
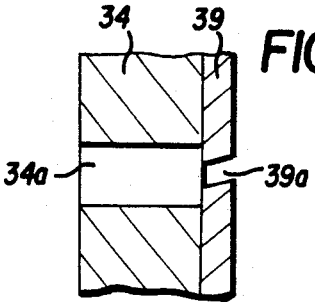
Figure 18:
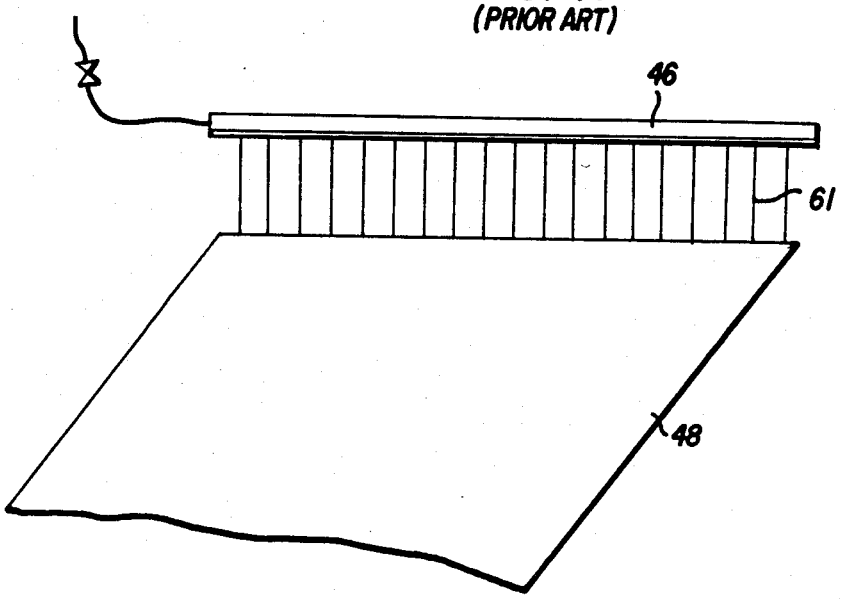
FIG. 18 (PRIOR ART)
FIG. 18 is a perspective side view of the conventional equipment.

In FIG. 14, the slit flow path 39*a* in the slit plate 39 is inclined against the center line of the drilled hole 34*a* in the drill plate 34. In this case, the direction of the jet at the outlet of the slit flow path 39*a* is changed. In FIG. 15, the slit flow path 40*a* in the slit plate 40 is bent. In this case, therefore, the direction of the jet at the outlet of the slit flow path 40*a* can be made nearly parallel to the surface of the drill plate 34.

Referring now to FIGS. 16(A) and (B) and FIGS. 17(A) and (B), description will be made for the configuration and pattern of the holes in the drill plate. FIGS. 16(A) and (B) illustrate the drill plate 43 having the holes arrayed in a square pattern, and reference numeral 43*a* designates the drilled hole in the drill plate 43. In FIGS. 16(A) and (B) and FIGS. 17(A) and (B), reference numeral 44 designates the slit plate. FIGS. 17(A) and (B) illustrate the drill plate 45 having the holes arrayed in an oblique pattern, and reference numeral 45*a* designates the drilled hole in the drill plate 45.

Figure 19:
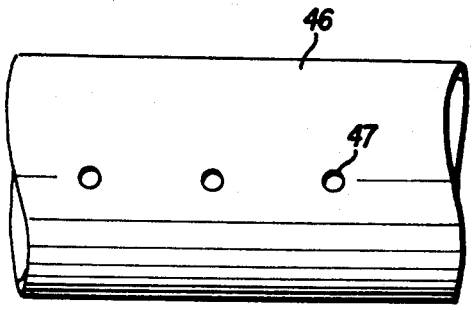
FIG. 19 (PRIOR ART)
FIG. 19 is a front view of the pipe in FIG. 18.
Figure 20:
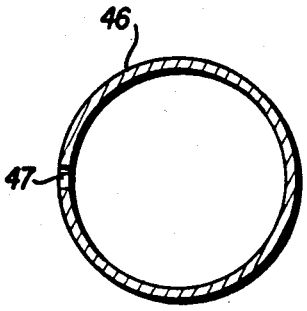
FIG. 20 (PRIOR ART)
FIG. 20 is a cross-section side view of FIG. 19.
Figure 24:
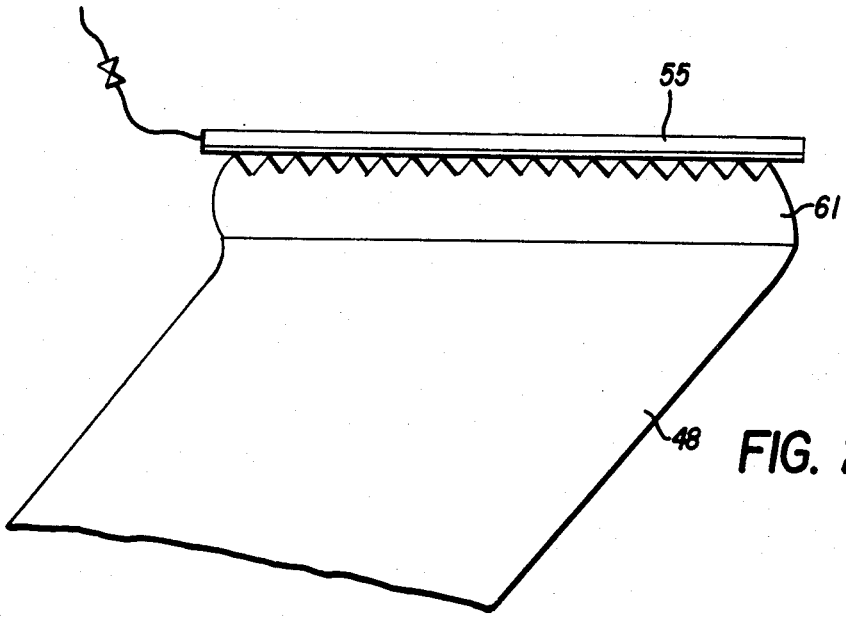
FIG. 24 is a perspective side view of the shower equipment provided with the drill plates and the slit plates representing an embodiment of the present invention.
Figure 25A:
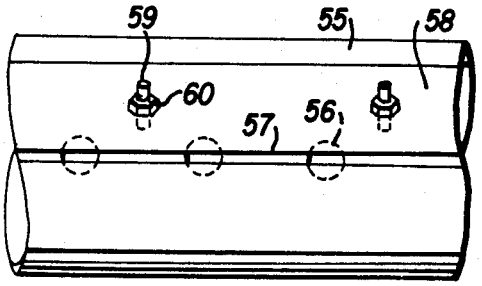
FIG. 25(A) is a front view of the pipe in FIG. 24.
Figure 25B:
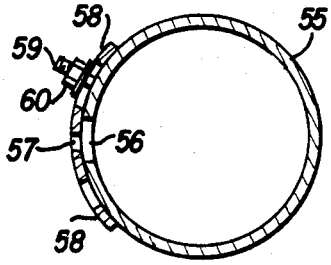
FIG. 25(B) is a cross-section side view of FIG. 25(A)

FIG. 24 and FIG. 25 illustrate an embodiment of the present invention employing the drill plates and the slit plates previously described, wherein reference numeral 55 is the pipe, reference numeral 56 is the drilled hole, reference numeral 57 is the slit, reference numeral 58 is the slit plate, reference numeral 59 is the bolt, reference numeral 60 is the nut, reference numeral 48 is the travelling belt, and reference numeral 61 is the shower. As compared with the embodiment shown in FIG. 18 through FIG. 20, this embodiment can obtain a slit-shaped jet, and display higher performance than the nozzle provided only with the drilled holes 47. Furthermore, as compared with the nozzle provided only with the slit 51 in FIGS. 21 through 23, this nozzle can easily reduce the opening rate and uniformly distribute the flow rate in the widthwise direction. In addition, since the slit 57 includes two plates 58 as shown in FIG. 25(B), the width of the slit 57 can easily be adjusted, and machining is easier than the nozzle provided only with the slit 57 in FIGS. 21 through 23.

Since the present invention is constituted as specifically described above, the jet flow in the form of a widthwise extended film can be obtained after flowing out of the drilled holes 56 and the slit 57, the length of the sluice flow path can be shorter than the prior art, and the uniform flow in a widthwise direction can be obtained. In addition, according to the present invention, since the jet flow extends in the widthwise direction immediately after flowing out of the drill plate and the slit plate 58, the part with low concentration is extremely less than the prior art, and the generation of the streak with low concentration is restricted. Moreover, the sluice chamber is shortened in length and improved in vibration resistance. Also, irregularity of measurement of the paper liquid in the flow direction is eliminated.

Besides the above-mentioned advantages, since the flow rectifier consisting of the drill plate and the slit plate 58 according to the present invention hardly gives rise to irregularity in speed in the downstream side due to the influence of ejection, it enables the opening rate to be reduced, gives the same or more resistance than the conventional prior art (tube bank)+(perforated plate), and can be used in place of the conventional arrangement (tube bank)+(killing part)+(perforated plate), resulting in space saving. Furthermore, since the direction of flow can be changed in the drill plate, the upstream side of the perforated plate can sufficiently be served by the header pipe 55 where the paper liquid flows in the widthwise direction. And, in the slit plate 58, since the paper liquid flows while extending in the direction of the slit, the lump of the fiber is expanded, torn off, and thereby well dispersed.

Now, referring further to FIGS. 26(A) and (B), FIGS. 27(A) and (B) and FIGS. 28(A) and (B), description will be made for another embodiment of the invention. FIGS. 26(A) and (B), FIGS. 27(A) and (B), and FIGS. 28(A) and (B) are cross-sectional views of the head box, wherein reference numeral 14 is a rectangular header, reference numeral 61 is a slit plate in the upstream side, reference numeral 62 is a slit plate in the downstream side, reference numeral 63 is a top plate, reference numeral 64 is a bottom plate, reference numeral 65 is a restraining element, reference numeral 66 is a sluice lip, and the cross-sectional area of the rectangular header 14 is decreased while proceeding downstream by lessening its width.

The upstream slits are formed by the mutual intervals of the slit plates 61, and the downstream slits crossing with the upstream slits are formed by the mutual intervals of the slit plates 62. The sectional area of the flow path in the sluice chamber located in the downstream side of the flow rectifier is increased or decreased by the restraining elements 65.

FIGS. 27(A) and (B) illustrate the head box where the flow rectifier according to the present invention is combined with the sluice chamber so that the sectional area of the flow path in the sluice chamber is increased or decreased by the shape of the wall surface of the sluice chamber. FIGS. 28(A) and (B) illustrate the head box where the flow rectifier according to the present invention is combined with the sluice chamber so that the flow path in the sluice chamber is fitted to the clearance of the downstream slit plate 62.

Proceeding now to the description of the function of the above-mentioned embodiments, in FIGS. 26(A) and (B), FIGS. 27(A) and (B), and FIGS. 28(A) and (B), the raw paper liquid flowing in the rectangular header 14 is diverged into the slits formed by the mutual intervals of the slit plates 61 as flowing in the widthwise direction, thus the distribution in the widthwise direction and the change of direction are realized.

Then, in FIG. 29 through FIG. 31, since the raw paper liquid flowing through the range a passes through the slit b, there exist flows in the directions shown by the arrow marks X and Y. These flows collide with each other at the slit formed by the slit plate 76. Since, however, the flow is restricted in the direction shown by the arrow mark Z, it is rapidly expanded in the direction shown by the arrow mark Y. In these drawings of FIG. 29 through FIG. 31, reference numeral 75 is one slit plate, and reference numeral 76 is another slit plate fitted by the bolt 77 in the downstream side so that both slit plates 75 and 76 are crossing with each other.

Figure 32:
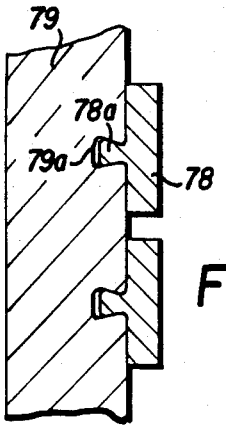
FIG. 32, FIG. 33, FIG. 34, FIG. 35(A) and FIG. 36(A) are cross-section side views of the slit plate and the slit structure of embodiments of the present invention different from each other.

Then, the means to form the mutually crossing slits will be described herebelow with reference to FIG. 32 through FIGS. 36(A) and (B). In FIG. 32, the slit plate 78 has the projection 78*a* perpendicular to the sheet surface, which is fixedly inserted into the groove 79*a* perpendicular to the sheet surface of the slit plate 79.

Figure 33:
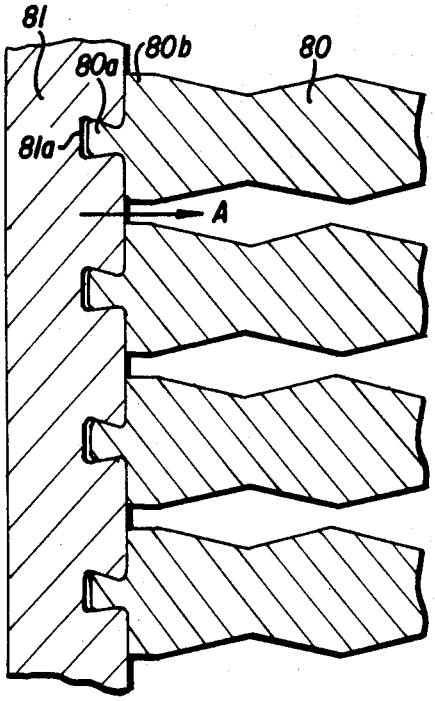

In FIG. 33, the restraining element 80 extending perpendicularly to the sheet surface has the projection 80*a*, which is fixedly inserted into the groove 81*a* of the slit plate 81. The slit is formed by the fitting part 80*b* of the restraining element 80. The arrow mark A shows the direction of flow.

Figure 34:
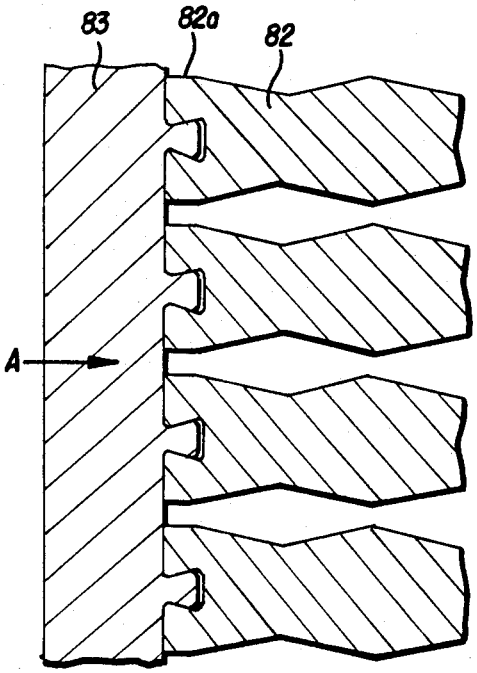

In FIG. 34, a groove is provided in the restraining element 82, and a projection is provided on the slit plate 83. The slit is formed by the fitting part 82*a* of the restraining element 82. Again, the arrow mark A shows the direction of flow.

Figure 35A:
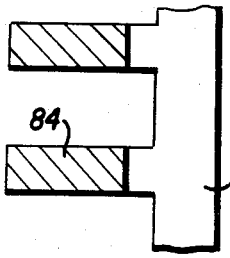
Figure 35B:
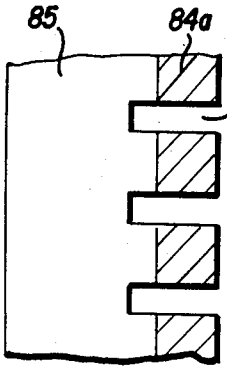
FIG. 35(B) and FIG. 36(B) are respectively cross-section plan views of FIG. 35(A) and FIG. 36(A)
Figure 36A:
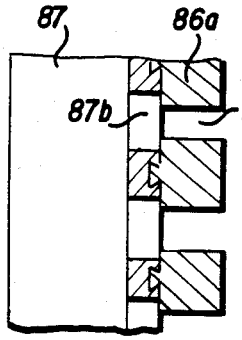

As shown in FIGS. 35(A) and (B), mutually crossing slits 85, and 85*a* can be formed by the integrally constructed slit plates 84 and 84*a*. In this case, it is possible to give sufficient depth to the slits 85 and 85*a* to cross them directly, but it is also possible, as shown in FIGS. 36(A) and (B), to give smaller depth to the slits 87 and 87*a* of the slit plates 86 and 86*a* and connect them through the medium of the hole 87*b*. Furthermore, the downstream slit 87*a* in FIG. 36 can be formed by the restraining elements 80 and 82 as shown in FIG. 33 and FIG. 34. It is to be noted that, in the above-mentioned embodiments, the slit plates 81, 83, 84 and 86 and the restraining elements 80 and 82 can be made of plastic and other materials instead of metal.

Figure 37:
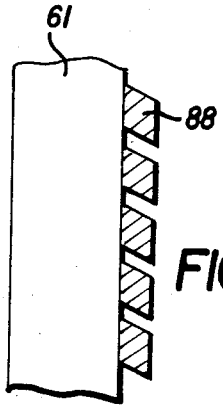
FIG. 37 and FIG. 38 are cross-section side views of a slit plate of different shape from the above-mentioned slit plate of FIGS. 32–36.
Figure 38:
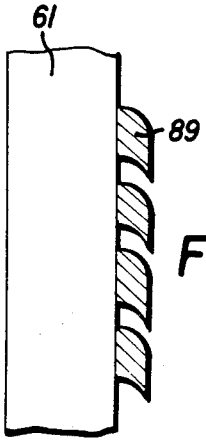
Figure 36B:
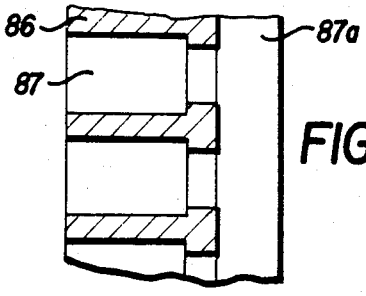
Figure 39:
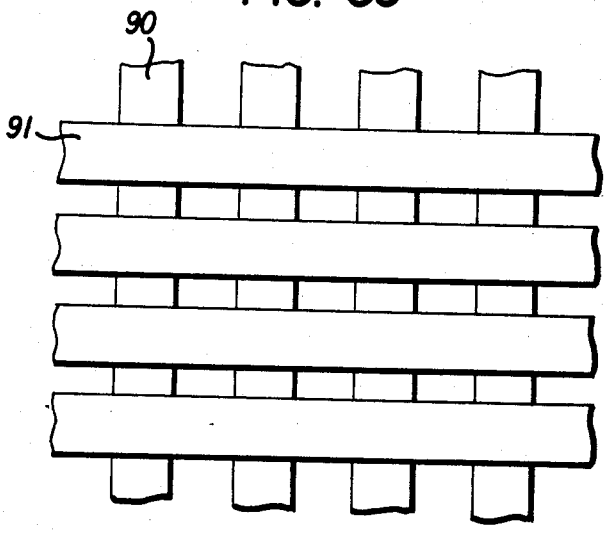
FIG. 39 and FIG. 40 are front views showing the combination pattern of the slit plates on an upstream side or a downstream side of the present invention.
Figure 40:
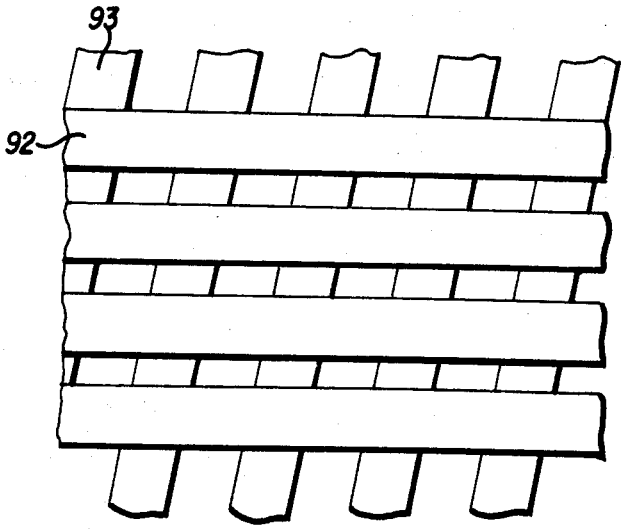

As shown in FIG. 37 and FIG. 38, the direction of the jet flowing out of the slit can be changed by changing the slit angle, i.e., the shape of the downstream slit plate 88 and 89. In these drawings for FIGS. 37 and 38 reference numeral 61 designates the upstream slit plate. It is to be noted that the slit plates 61 and 88 or 89 can be crossed in the same manner either orthogonally as shown in FIG. 39 by slit plates 90 and 91 or obliquely as shown in FIG. 40 by slit plates 92 and 93. It is further to be noted that, although in the above-mentioned embodiments the flow path of the raw paper liquid passes through the first slit and then crosses the second slit, the number of steps of this crossing may be increased to three or more steps.

Figure 42:
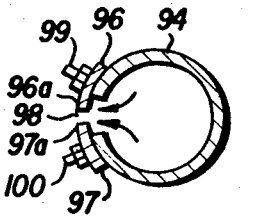
FIG. 42 is a cross-section side view of FIG. 41.
Figure 41:
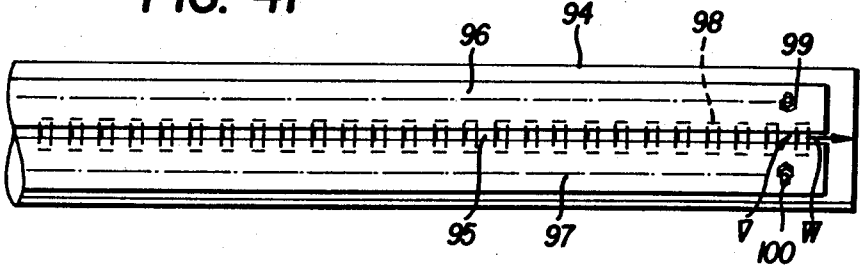
FIG. 41 is a front view of the shower equipment applying a flow rectifier representing an embodiment of the present invention.

FIG. 41 and FIG. 42 illustrate the shower equipment applying the slit and the slit flow rectifier representing the embodiment of the present invention. As shown in these drawings, the slits 95, shaped into slender configuration in the circumferential direction of the pipe 94, are formed along the lengthwise direction of the pipe 94. The slit plates 96 and 97 form the slit 98 in the lengthwise direction of the pipe 94. The slit plates 96 and 97 are fixed to the pipe 94 by the bolts 99 and 100.

The raw paper liquid having flowed in the pipe 94 along its lengthwise direction causes at the slit 95 the flow as shown by the arrow mark Z in the circumferential direction of the pipe 94. This flow is turbulent at the slit 98. Since, however, the flow is restricted against the end surfaces 96*a* and 97*a* of the slit plates 96 and 97, the flow expands in the lengthwise direction of the pipe 94, causing the flows shown by the arrow marks W and V. Thus, a jet in the form of a widthwise continuous film is obtained from the slit 98. In this case, since the slit 98 continuously extended in the lengthwise direction of the pipe 94 is not required to be cut, the pipe 94 is rarely deformed by the liquid pressure. In addition, the flow rate can be adjusted by changing the clearance of the slit 98 by simply adjusting positions of the slit plates 96 and 97.

As clearly known from the specific description stated above, this embodiment provides the same function and effect as the previously described embodiments.

What is claimed is:

1. A head box with a top plate and a bottom plate, having a flow rectifier, in a paper-making machine, comprising:

a slice lip having an opening formed by the top plate and the bottom plate at one end of the head box;

a first flow control member having an outlet and being disposed in an upstream side of a main flow passage;

a second flow control member having an outlet and being disposed in a downstream side of, and having a front surface protruding partially across and being in direct contact with, the outlet of the first flow control member;

at least one row of bore means arrayed in a widthwise direction of the first flow control member;

at least one row of slitted flow passages arrayed in a widthwise direction of the second flow control member;

each slitted flow passage having an opening in the widthwise direction of the second flow control member;

each opening in each slitted flow passage being narrower than each bore means in a direction perpendicular to the opening in the slice lip at the outlet of the first flow control member;

each opening in each slitted flow passage being parallel to the opening in the slice lip;

whereby flow through the main flow passage is throttled at the front surface of the second flow control member so that the flow is rapidly decelerated in the openings of the slitted flow passages to a uniform flow rate distribution in the widthwise direction across the entire outlet of the second flow control member before exiting through the parallel opening in the slice lip in order to eliminate streaks of raw paper liquid with low concentration of fibers.

* * * * *